US007908693B2

(12) United States Patent
DeMoss

(10) Patent No.: US 7,908,693 B2
(45) Date of Patent: Mar. 22, 2011

(54) COIL-IN COIL SPRINGS AND INNERSPRINGS

(75) Inventor: Larry K. DeMoss, Greensboro, NC (US)

(73) Assignee: Sealy Technology LLC, Trinity, NC (US)

( * ) Notice: Subject to any disclaimer, the term of this patent is extended or adjusted under 35 U.S.C. 154(b) by 0 days.

(21) Appl. No.: 12/760,110

(22) Filed: Apr. 14, 2010

(65) Prior Publication Data

US 2010/0257675 A1 Oct. 14, 2010

Related U.S. Application Data

(60) Provisional application No. 61/169,039, filed on Apr. 14, 2009.

(51) Int. Cl.
*A47C 23/04* (2006.01)

(52) U.S. Cl. ..... 5/720; 5/246; 5/248; 5/256

(58) Field of Classification Search ..... 5/246, 248, 5/256, 258, 720, 655.8, 716
See application file for complete search history.

(56) References Cited

U.S. PATENT DOCUMENTS

| | | | | |
|---|---|---|---|---|
| 2,631,840 | A | 3/1953 | Bugenhagen | |
| 3,076,203 | A * | 2/1963 | Verreau | 5/256 |
| 4,679,266 | A * | 7/1987 | Kraft | 5/716 |
| 6,021,627 | A | 2/2000 | Mossbeck et al. | |
| 6,122,900 | A | 9/2000 | Mossbeck et al. | |
| 6,155,310 | A | 12/2000 | Haubert et al. | |
| 6,398,199 | B1 | 6/2002 | Barber | |
| 6,668,406 | B2 * | 12/2003 | Spinks et al. | 5/655.8 |
| 6,688,457 | B2 | 2/2004 | Haubert et al. | |
| 7,178,187 | B2 | 2/2007 | Barman et al. | |
| 7,194,777 | B2 | 3/2007 | Edling et al. | |
| 7,404,223 | B2 | 7/2008 | Manuszak et al. | |
| D579,242 | S * | 10/2008 | Kilic | D6/504 |
| 2004/0046297 | A1 | 3/2004 | DeMoss et al. | |
| 2005/0257883 | A1 | 11/2005 | Anagnostopoulos | |
| 2007/0017035 | A1 | 1/2007 | Chen et al. | |
| 2008/0184493 | A1 | 8/2008 | Mossbeck et al. | |

FOREIGN PATENT DOCUMENTS

| | | |
|---|---|---|
| WO | WO2008143595 | 11/2008 |
| WO | WO2009/029057 | 3/2009 |

* cited by examiner

*Primary Examiner* — Fredrick Conley

(74) *Attorney, Agent, or Firm* — Roetzel & Andress

(57) ABSTRACT

A mattress innerspring having coil-in-coil springs arranged in an array. Each coil-in-coil spring an outside helical coil and an inside helical coil, wherein the outside helical coil has a greater height and diameter than the inside helical coil, each coil having a dual spring rate between that of the outside helical coil and the combined spring rates of the outside and inside helical coils. The coil-in-coil springs may be pocketed or unpocketed in a mattress innerspring.

19 Claims, 5 Drawing Sheets

COIL-IN COIL SPRINGS AND INNERSPRINGS

RELATED APPLICATIONS

This application claims priority to U.S. Provisional Patent Application No. 61/169,039 filed on Apr. 14, 2009, which is incorporated herein by reference.

FIELD OF THE INVENTION

The present invention is in the general field of innerspring and coil designs and more specifically to coil-in-coil springs and innersprings for mattresses and other bedding products.

BACKGROUND OF THE INVENTION

Mattress innersprings, or simply "innersprings", made of matrices or arrays of a plurality of wire form springs or coils, have long been used as the reflexive core of mattress padding and upholstery is arranged and attached around the innerspring. Innersprings made of formed steel wire are mass produced by machinery which forms the coils from steel wire stock and interconnects or laces the coils together in the matrix array. With such machinery, design attributes of innersprings can be selected and modified, from the gauge of the wire, the coil design or combinations of designs, coil orientation relative to adjacent coils in the matrix array, and the manner of interconnection or lacing of the coils.

Mattresses and other types of cushions have for decades been constructed using conventional innersprings, which, due to their symmetrical construction resulting from the use of generally symmetrical coils as manufactured by coil production, have two sides (as defined by the coil ends) which provided reflective support. The conventional innerspring typically consists of a series of hour-glass shaped-springs that are adjoined by lacing end convolutions together with cross helical wires. An advantage of this arrangement is that it is inexpensive to manufacture. However, this type of innerspring provides a firm and rigid mattress surface.

Another type of coil that has been used in mattress construction is the pocketed coil. A pocketed coil is a spring wrapped in a cloth cover. The springs are arranged in succession and the pockets are sewn together to form a cohesive unit. This type of innerspring provides a more comfortable mattress surface because the springs become relatively individually flexible, so that each spring may flex separately without affecting the neighboring springs. However, this type of innerspring design is more expensive to construct and also more prone to sagging than the conventional hour-glass shaped, non-pocketed innerspring.

Innerspring designs of the prior art attempt overcome the limitations of existing innerspring designs with varying heights, helical turns, and spring rates along with variations on placement and orientation have all been individually introduced in an effort to improve innerspring design or to compliment a particular mattress design. However, these designs and configurations are typically focused on improving one aspect of mattress design, such as comfort, affordability, ease of manufacture, or durability. And the physical properties, i.e. spring characteristics of single wire springs are constrained by the gauge of wire used, the height of the coil, the number and radius of turns or convolutions in a helical spring body, and the end configurations.

SUMMARY OF THE INVENTION

A coil-in-coil spring provides an alternative innerspring design wherein the advantages of several existing innersprings are realized. The coil-in-coil spring offers the positive aspects of having varying spring heights, springs with a differing number of helical turns and springs with diverse spring rates. It also accommodates furniture serving in dual capacities, such as a daybed.

The present disclosure and related inventions describe an innerspring for a mattress which includes an array of nested or coil-in-coil springs. The outside coil is greater in both height and diameter than the inside coil. The inside coil contains more helical turns or convolutions than the outside coil and thus also has a greater spring rate than the outside coil. In one embodiment, the coil-in-coil springs are encased in individual "pockets" before being joined together in rows to form an innerspring. In a second embodiment, the coil-in-coil springs are joined together by helical lacing wires which run between rows of the coils and which wrap or lace around tangential or overlapping segments of adjacent coils.

In accordance with one embodiment of the invention, there is provided a mattress innerspring made of a plurality of coil-in-coil springs, each coil-in-coil spring having an outside helical coil and an inside helical coil; the outside helical coil having an upper end convolution and a lower end convolution opposite the upper end convolution, an uncompressed height of approximately 8.25 inches and having a total of approximately 5 helical convolutions; the inside helical coil having an upper end convolution and a lower end convolution opposite the upper end convolution, an uncompressed height of approximately 5.75 inches and having a total of approximately 7 helical convolutions; wherein the diameter of the upper end convolution of the outside helical coil is less than the diameter of the previous convolutions of the outside helical coil and the diameter of the lower end convolution of the inside helical coil is greater than the subsequent convolutions of the inside helical coil; and wherein the wire gauge of the coil-in-coil springs is approximately between 13 and 16 and each coil-in-coil spring is double-annealed, individually pocketed and arranged in a matrix.

In accordance with another aspect and embodiment of the invention, there is provided a mattress innerspring which has a plurality of coil-in-coil spring, each coil-in-coil spring having an outside helical coil and an inside helical coil; the outside helical coil having an upper end convolution and a lower end convolution opposite the upper end convolution, an uncompressed height of approximately 8.25 inches and a total of approximately 5 helical convolutions; the inside helical coil having an upper end convolution and a lower end convolution opposite the upper end convolution, an uncompressed height of approximately 5.75 inches and a total of approximately 7 helical convolutions; wherein the diameter of the upper end convolution of the outside helical coil is approximately 64 mm and the diameter of the previous convolutions of the outside helical coil is approximately 70 mm; wherein the diameter of the lower end convolution of the inside helical coil is approximately 40.8 mm and the diameter of the subsequent convolutions of the inside helical coil is approximately 32.8 mm; and wherein the wire gauge of the coils is approximately between 14 and 15.5 and each coil is double-annealed, arranged in a matrix and laced together with helical lacing wire.

And in accordance with another aspect and embodiment of the invention, there is provided a mattress innerspring having a plurality of coil-in-coil springs individually pocketed and arranged in a matrix, each coil-in coil spring having an outside helical coil extending in a counter-clockwise direction and an inside helical coil extending in a clockwise direction; the outside helical coil having an uncompressed height of approximately 8.25 inches, a pocketed height of approximately 6.5 inches, a diameter of approximately 70 mm, a stiffness of approximately 0.45 lb/in, at least 5 helical convolutions, and a center convolution pitch dimension of approximately 55.6 mm; the inside helical coil having an uncompressed height of approximately 5.75 inches, a diameter of approximately 32.8 mm, a stiffness of approximately 1.9 lb/in, at least 7 helical convolutions, and a center convolution pitch dimension of approximately 20 mm, and wherein each coil-in-coil spring is double annealed.

These and other aspects of the disclosure and related inventions are further described herein in detail with reference to the accompanying drawings.

DETAILED DESCRIPTION OF PREFERRED AND ALTERNATE EMBODIMENTS

Figure 1:
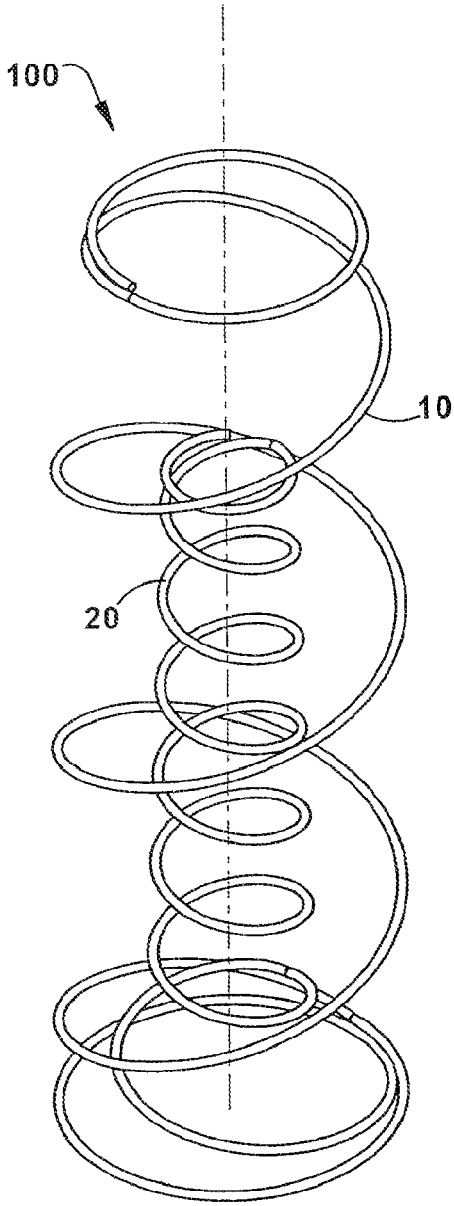
FIG. 1 is a perspective view of a coil-in-coil spring.
Figure 2:
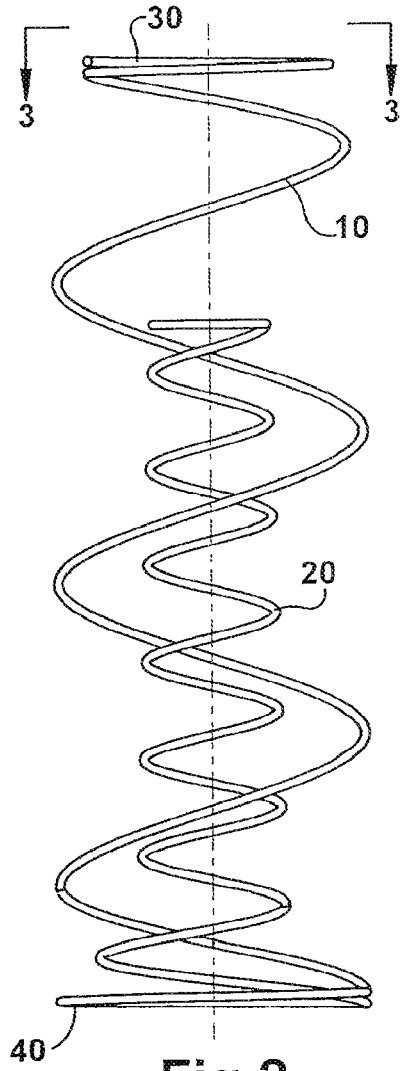
FIG. 2 is a side view of the coil-in-coil spring of FIG. 1.
Figure 3:
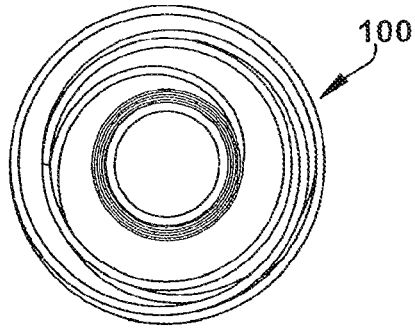
FIG. 3 is a top view of the coil-in-coil spring of FIG. 2 from the 3-3 arrows.
Figure 4:
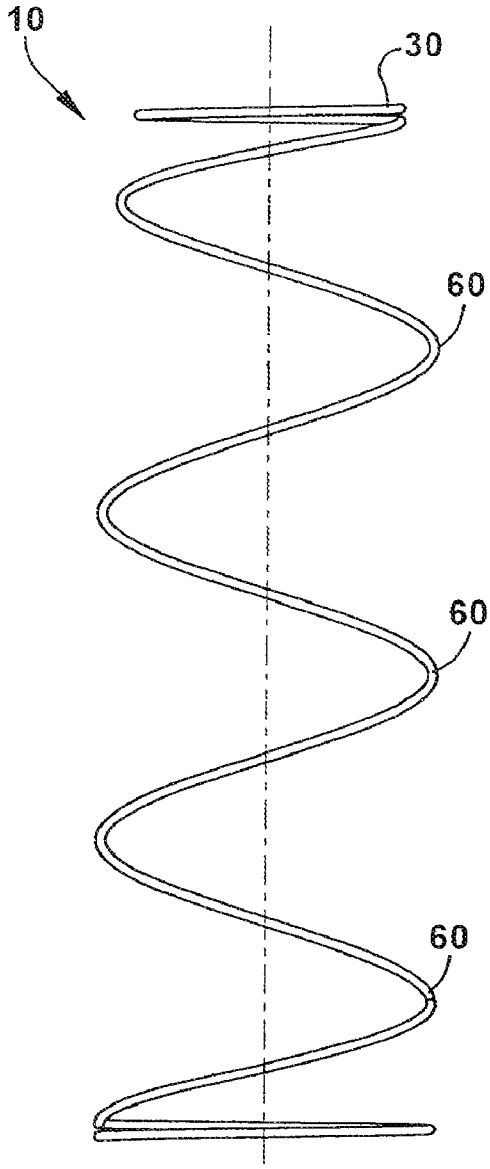
FIG. 4 is an exploded side view of the outside coil of the coil-in-coil spring of FIG. 1
Figure 5:
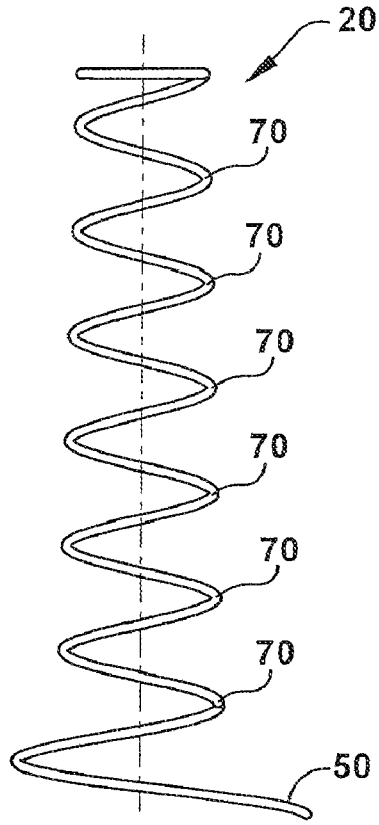
FIG. 5 is an exploded side view of the inside coil of the coil-in-coil spring of FIG. 1
Figure 6:
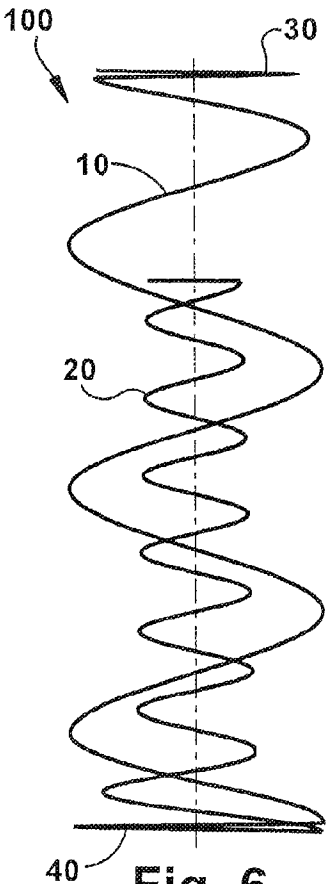
FIGS. 6 through 9 are side views of the coil-in-coil spring of FIG. 1 in various states of compression.
Figure 7:
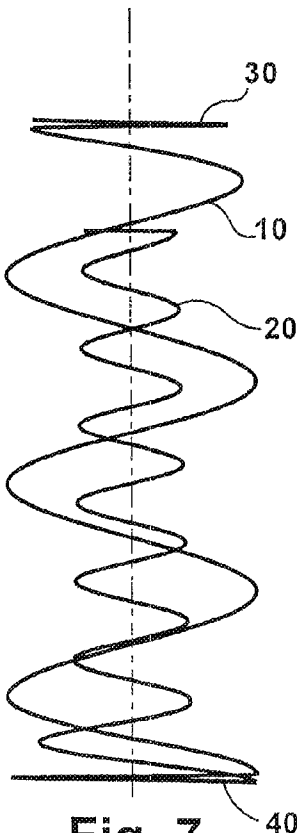
Figure 8:
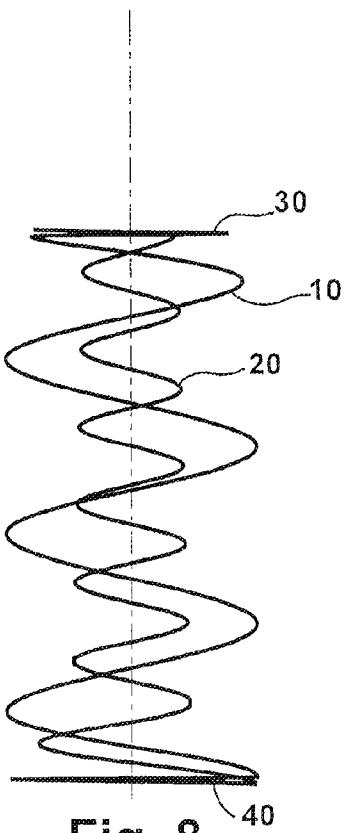
Figure 9:
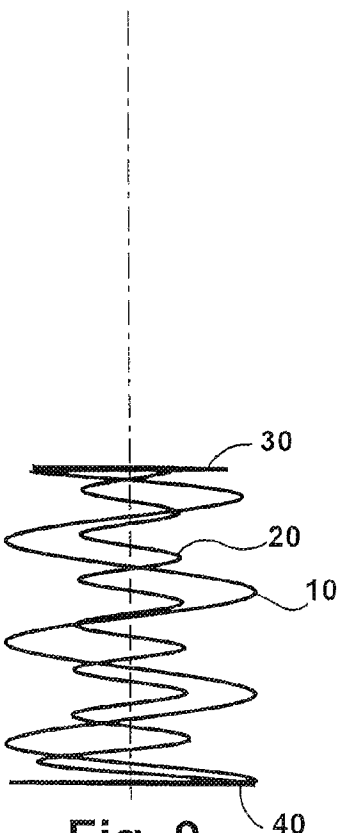

FIG. 1 is a perspective view of a representative coil-in-coil spring 100 of the present invention. The outside coil 10 and inside coil 20 are coaxial, helical formed springs made from a single strand of spring wire or other suitable material. As shown in FIG. 2, the outside coil begins with a flat base that continues upward in a spiral section to form the body of the spring. The upper end convolution 30 of the outside coil 10 ends in a circular loop at the extreme end of the spring. The ends are punch-formed to provide a foot or supporting surface for interface with overlying padding and upholstery. The base 40 is formed with a double circular loop with the inside loop extending upward in a spiral to form the inside coil 20. As can be seen in the Figures, the outside coil 10 is larger in height than the inside coil 20. Also, the diameter of the outside coil 10 is larger than the diameter of the inside coil 20, which ensures there is no interference between the outside 10 and inside 20 coils. In a preferred embodiment, the outside coil has a height of approximately 8.25 inches with a diameter of approximately 70 mm and the inside coil has a height of approximately 5.75 inches with a diameter of approximately 32.8 mm. The outside coil 10 extends in a counter-clockwise direction and the inside coil 20 extends in a clock-wise direction. There are contiguous end convolutions at opposite ends of the coil body. The end convolutions of the coil are generally circular, terminating in a generally planar form which serves as the supporting end structure of the coil for attachment to adjacent coils and for the overlying application of padding and upholstery. As shown in FIG. 3, with the exception of the upper end convolution 30, all convolutions of the outside coil 10 have the same diameter and with the exception of the lower end convolution 50, all convolutions of the inside coil 20 have the same diameter. In a preferred embodiment, there are 5 convolutions or turns which make up the body of the outside coil 10. The diameter of upper end convolution 30 of the outside coil is approximately 64 mm while the diameter of the preceding or center convolutions 60 is approximately 70 mm. The coil dimension measured from an outermost edge of one convolution to the adjacent convolution is referred to herein as "pitch". The center convolutions 60 of the outside coil 10 have an approximate pitch dimension of 55.6 mm. The outside coil 10 in raw form, as shown in FIG. 4, has a free or uncompressed height of approximately 8.25 inches. The free standing height of the inside coil 20, as shown in FIG. 5, is approximately 5.75 inches. The body of the inside coil 20 contains 7 convolutions or turns. The diameter of the lower end convolution 50 of the inside coil 20 is approximately 40.8 mm while the diameter of the subsequent or center convolutions 70 is approximately 32.8 mm. The center convolutions 70 of the inside coil 20 have an approximate pitch dimension of 20 mm. Alternate embodiments of the coil may be constructed with different configurations, such as different numbers of convolutions or turns, and different shapes to the end coils.

In a preferred embodiment, the spring rate of the inside coil 20 is greater than the spring rate of the outside coil 10. Spring rate refers to the amount of weight needed to compress a spring one inch. The coil-in-coil nested design provides two different spring rates during compression of the mattress. During initial loading, only the outside coil 10 is compressed whereas under a heavy or concentrated load, both the inside and outside coil work to support the load. This allows for a comfortable compression under a light load when used for sleeping wherein the load is distributed over a relatively large surface area, while also maintaining the comfort while supporting a heavy load concentrated in one location when one is seated upon the mattress surface. The upper portion or outside coil 10 is flexible enough to provide a resilient and comfortable seating or sleeping surface and the lower portion is strong enough to absorb abnormal stresses, weight concentrations or shocks without discomfort or damage. The relative spring rates also provide a gradual transition between the outer to inner coil upon compression so that the shift from compression of the outer coil only to the compression of both the outer and inner coils as the load increases is not felt by one seated upon the mattress surface. FIGS. 6 through 9 show the coil-in-coil spring 100 in various states of compression. In a preferred embodiment, the outside coil 10 must be compressed 2.25 inches before the inside coil 20 becomes engaged and the force required to reach the inside coil 20 is 1.125 lbs. The outside coil 10 stiffness is approximately 0.45 lb/in. and the inside coil 10 stiffness is approximately 1.9 lb/in. for a combined stiffness of 2.35 lb/in.

In assembling the coil-in-coil spring 100 of the present invention and related disclosure, the spring is wound from a single strand of suitable material such as conventional spring wire with a length of approximately 1930 mm. Material selection may be based on a number of factors, including temperature range, tensile strength, elastic modulus, fatigue life, corrosion resistance, cost, etc. High carbon spring steels are the most commonly used of all spring materials. They are relatively inexpensive, readily available, and easily worked. Spring wire used in mattress coil spring construction has typically a diameter of between approximately 0.06 inches (16 gauge) and approximately 0.09 inches (13 gauge). The exact design parameters for mattress coil springs depend on the desired firmness, which is in addition determined by the number of springs per unit surface area of the mattress. In a preferred embodiment, the coil wire is approximately 14⅞ gauge.

Coil formation may be performed by wire formation machinery. Generally, coil formers feed wire stock through a series of rollers to bend the wire in a generally helical configuration to form individual coils. The radius or curvature in the coils is determined by the shapes of the cams in rolling contact with a cam follower arm. The coil wire stock is fed to the coiler by feed rollers into a forming block. As the wire is advanced through a guide hole in the forming block, it contacts a coil radius forming wheel attached to an end of the cam follower arm. The forming wheel is moved relative to the forming block according to the shapes of the cams which the arm follows. The radius of curvature of the wire stock is set as the wire emerges from the forming block. A helix is formed in the wire stock after it passes the forming wheel by a helix guide pin which moves in a generally linear path, generally perpendicular to the wire stock guide hole in the forming block in order to advance the wire in a helical path away from the forming wheel. Once a sufficient amount of wire has been fed though the forming block, past the forming wheel and the helix guide pin, to form a complete coil, a cutting tool is advanced against the forming block to sever the coil from the wire stock. The severed coil is then advanced by a geneva to subsequent formation and processing stations. A geneva with, for example, six geneva arms, is rotationally mounted proximate to the front of the coiler. Each geneva arm supports a gripper operative to grip a coil as it is cut from the continuous wire feed at the guide block.

Once each coil has been formed, the coils are heat-tempered and set in order to build memory into the spring to provide increased spring force as well as extended longevity of the action of the coil spring. The geneva advances each coil to a inside coil tempering station where the coil is held at its center by a gripper and an electrical current is passed through the coil to temper the steel wire. The heat-tempering process includes heating the coil springs to a temperature of about 500 degrees Fahrenheit (about 260 degrees Celsius) to about 600 degrees Fahrenheit (about 316 degrees Celsius) by applying 50 amperes of current for approximately one second from one end of the spring to the other. Once the inside coil is annealed, the geneva advances the coil to the outside coil tempering station where the annealing process is repeated on the outside coil. The coil-in-coil spring is double annealed so that both the inside and outside coils are annealed and set. In a seriatim annealing process, the outer coil is annealed in a first process followed by annealing of the inner coil, or vice versa.

Figure 11:
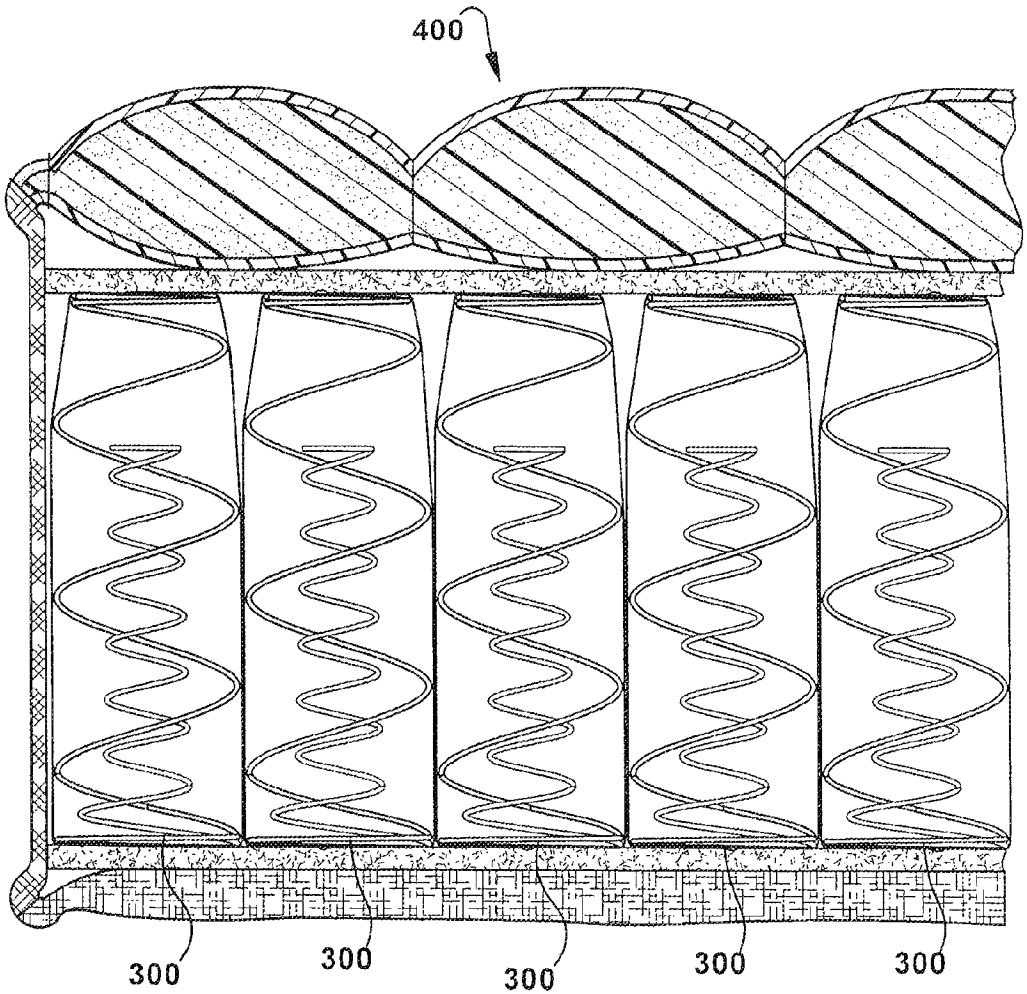
FIG. 11 is a cutaway view of the pocketed coil-in-coil spring of FIG. 10 as part of a mattress assembly.
Figure 10:
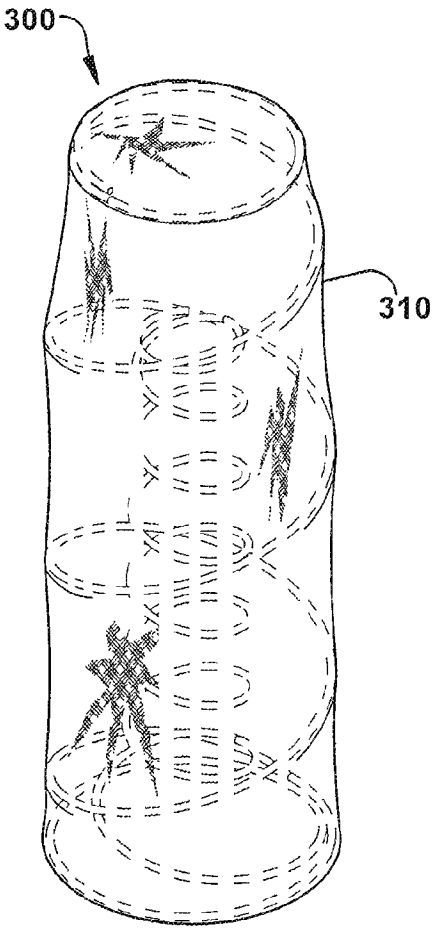
FIG. 10 is a pocketed coil-in-coil spring of FIG. 1

After the coils are heat-tempered and set, they must be joined together in rows in order to form an innerspring. In one embodiment, the coil-in-coil springs 100 are encased in individual pockets, as shown in FIG. 10. Each pocket 310 is defined by a top surface, a bottom surface and a side wall connecting the top surface and bottom surface. Pockets 310 are preferably formed from fabric composed of a material that allows for the fabric to be joined, or welded, together by heat and pressure, as in an ultrasonic welding or similar thermal welding procedure. For example, fabric may be composed of a thermoplastic fiber known in the art, such as non-woven polymer based fabric, non-woven polypropelene material or non-woven polyester material. Alternatively, the pockets 310 may be joined together by stitching, metal staples, or other suitable methods. In this case, a wide variety of textile fabrics or other sheet material may be used. The fabric is typically folded in half and joined together at the top surface and side edges to form, or define, a pocket. Each pocketed spring 300 is arranged in a succession of strings, after which each such strings are connected to each other side by side. FIG. 11 shows a cutaway view of a mattress assembly 400 containing a series of pocketed coil-in-coil springs 300. The interconnection of strings can take place by welding or gluing. Such interconnection, however, can alternatively be carried out by means of clamps or Velcro fasteners, or in some other convenient manner.

When the coil-in-coil spring 100 of the present disclosure is "pocketed" or placed into the individual pockets, the outside coil 10 is preferably in a slightly compressed state in which for example the total nominal height of the outside coil 10 is reduced by approximately 1.75 inches or to a total nominal height of approximately 6.5 inches. This decreases the outside to inside coil differential to approximately 0.75 inches. A representative force required to compress the outside coil 10 into the pocket is 0.7875 lbs.

Figure 12:
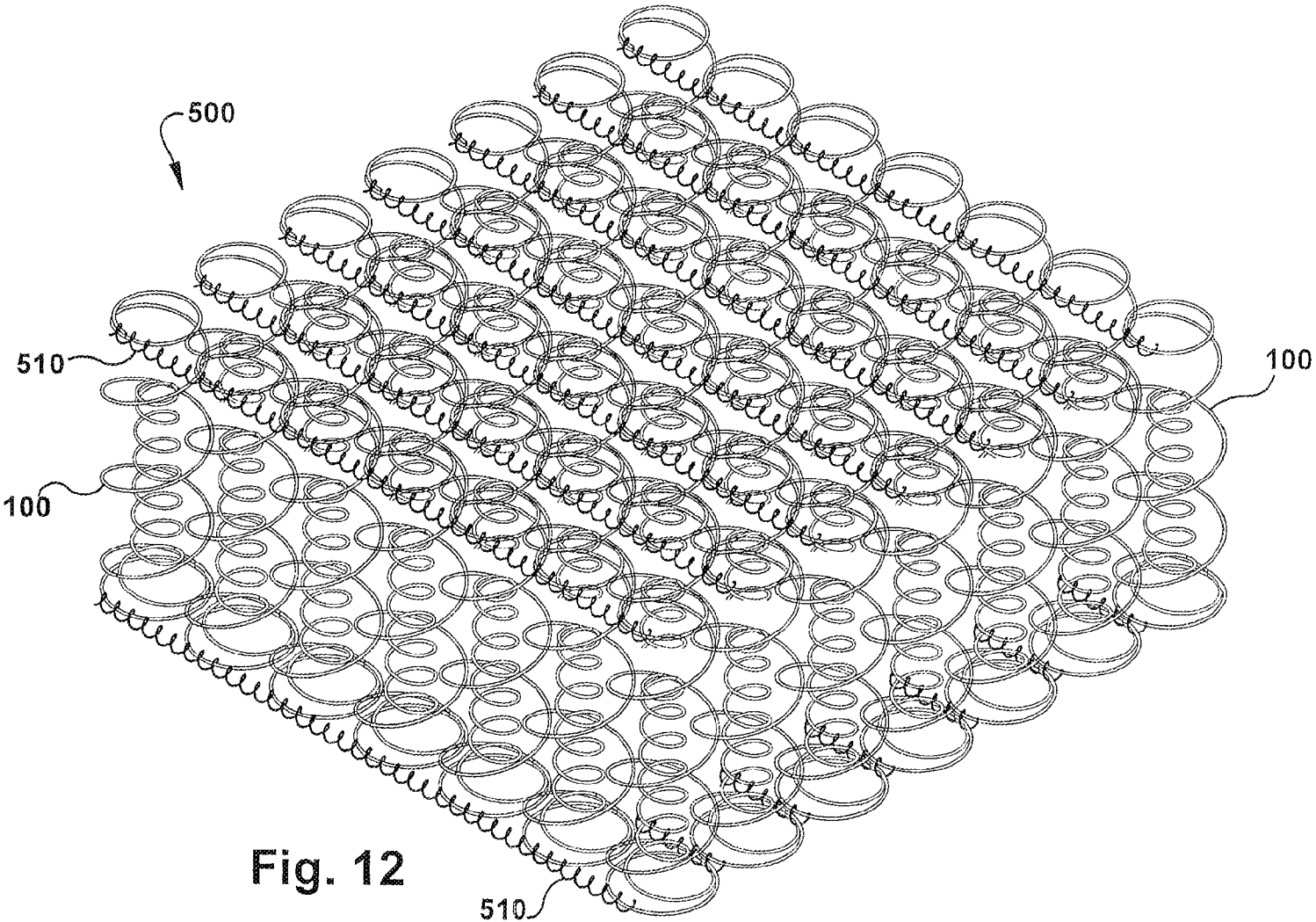
FIG. 12 is a perspective view of an innerspring mattress assembly utilizing unpocketed coil-in-coil springs of the present invention.

In a second embodiment, shown in FIG. 12, the coil-in-coil springs are "laced" or wire bound together in an array by helical lacing wires 510 which run between rows of the coils and which wrap or lace around tangential or overlapping segments of adjacent coils. The cross helical lacing wires 510 extend transversely between the rows of coils to form an innerspring 500 with a thickness equal to the axial length of the coils.

The coil-in-coil spring 100 of the present invention and related disclosures are capable of being baled. Baling refers to the process wherein innerspring units are compressed along the coil axes to a small fraction of the uncompressed height in order to reduce shipping volume. This is necessary for shipment of innersprings from a separate manufacturing facility to a finished product production facility, such as a mattress plant. The baling referred to herein includes bulk baling of at least several innersprings stacked together, separated by a sheet of material such as heavy paper, and compressed in the baler in bulk, as is common practice in the industry. The coils are designed to compress on-axis under the baling pressure required to simultaneously bale multiple innersprings.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

The invention claimed is:

1. A mattress innerspring comprising:

a plurality of coil-in-coil springs, each coil-in-coil spring having an outside helical coil and an inside helical coil made of a continuous wire;

the outside helical coil having an upper end convolution and a lower end convolution opposite the upper end convolution, an uncompressed height of approximately 8.25 inches and having a total of 5 helical convolutions;

the inside helical coil having an upper end convolution and a lower end convolution opposite the upper end convolution, the lower end convolution of the inside helical coil being continuous with the lower end convolution of the outside helical coil, the inside helical coil having an uncompressed height of approximately 5.75 inches and having a total of approximately 7 helical convolutions;

wherein the diameter of the upper end convolution of the outside helical coil is less than the diameter of the previous convolutions of the outside helical coil and the diameter of the lower end convolution of the inside helical coil is greater than the subsequent convolutions of the inside helical coil;

wherein the wire gauge of the coil-in-coil springs is approximately between 13 and 16 and each coil-in-coil spring is double-annealed, individually pocketed and arranged in a matrix in the mattress innerspring; and wherein the outside helical coil extends in a counter-clockwise direction and the inside helical coil extends in a clockwise direction.

2. The mattress innerspring of claim 1, wherein the outside helical coil height is approximately 6.5 inches when compressed inside the pocket.

3. The mattress innerspring of claim 1, wherein the compressed deflection strength of each coil-in-coil spring is approximately 0.805 lbs.

4. The mattress innerspring of claim 1, wherein the force needed to compress the outside helical coil until reaching the inside helical coil is approximately 0.7875 lbs.

5. The mattress innerspring of claim 1, wherein there are approximately 23 rows containing approximately 30 coils.

6. The mattress innerspring of claim 1, wherein the length of the wire needed to product one coil-in-coil spring is approximately 1,930 mm.

7. The mattress innerspring of claim 1, wherein the spring rate of the inside helical coil is approximately 3.475 lb/in.

8. The mattress innerspring of claim 1, wherein the stiffness of the outside helical coil is approximately 0.45 lb/in and the stiffness of the inside helical coil is approximately 1.9 lb/in.

9. The mattress innerspring of claim 1, wherein the pitch of the outside helical coil is approximately 55.6 mm and the pitch of the inside helical coil is approximately 20 mm.

10. A mattress innerspring comprising:

a plurality of interconnected coil-in-coil springs, each coil-in-coil spring having an outside helical coil and an inside helical coil which is connected to the outside helical coil;

the outside helical coil having an upper end convolution and a lower end convolution opposite the upper end convolution, an uncompressed height of approximately 8.25 inches and 4 or more helical convolutions;

the inside helical coil having an upper end convolution and a lower end convolution opposite the upper end convolution, an uncompressed height of approximately 5.75 inches and 6 or more helical convolutions;

wherein a diameter of the upper end convolution of the outside helical coil is approximately 64 mm and a diameter of the previous convolutions of the outside helical coil is approximately 70 mm;

wherein a diameter of the lower end convolution of the inside helical coil is approximately 40.8 mm and a diameter of other convolutions of the inside helical coil is approximately 32.8 mm;

wherein a wire gauge of the coils is in an approximate range of between 14 and 15.5 and each coil is double-annealed, arranged in a matrix and laced together with helical lacing wire; and wherein the outside helical coil extends in a counter-clockwise direction and the inside helical coil extends in a clockwise direction.

11. The mattress innerspring of claim 10, wherein there are approximately 23 rows containing approximately 30 coils.

12. The mattress innerspring of claim 10, wherein the compressed deflection strength of each coil-in-coil spring is approximately 0.805 lbs.

13. The mattress innerspring of claim 10, wherein the force needed to compress the outside helical coil until reaching the inside helical coil is approximately 1.125 lbs.

14. The mattress innerspring of claim 10, wherein the pitch of the outside helical coil is approximately 55.6 mm and the pitch of the inside helical coil is approximately 20 mm.

15. The mattress innerspring of claim 10, wherein the length of the wire needed to produce one coil-in-coil spring is approximately 1,930 mm.

16. The mattress innerspring of claim 10, wherein the spring rate of the inside helical coil is approximately 3.475 lb/in.

17. The mattress innerspring of claim 10, wherein the stiffness of the outside helical coil is approximately 0.45 lb/in and the stiffness of the inside helical coil is approximately 1.9 lb/in.

18. A mattress innerspring comprising:

a plurality of coil-in-coil springs, each coil-in-coil spring contained in a pocket and arranged in a matrix, each coil-in-coil spring having an outside helical coil with helical turns in a counter-clockwise direction, and an inside helical coil with helical turns in a clockwise direction;

the outside helical coil having an uncompressed height of approximately 8.25 inches, a pocketed height of approximately 6.5 inches, a diameter of approximately 70 mm, a stiffness of approximately 0.45 lb/in, at least 5 helical convolutions, and a center convolution pitch dimension of approximately 55.6 mm;

the inside helical coil having an uncompressed height of approximately 5.75 inches, a diameter of approximately 32.8 mm, a stiffness of approximately 1.9 lb/in, at least 7 helical convolutions, and a center convolution pitch dimension of approximately 20 mm;

wherein each coil-in-coil spring is double annealed.

19. The mattress innerspring of claim 18, wherein the outside helical coil of each coil-in-coil spring is in a partially compressed state in the pocket, and the inside helical coil is in an uncompressed state.

* * * * *